US009869489B2

(12) United States Patent
Fukunishi et al.

(10) Patent No.: US 9,869,489 B2
(45) Date of Patent: Jan. 16, 2018

(54) FAN ASSEMBLY AND WATER HEATER

(71) Applicant: NORITZ CORPORATION, Hyogo (JP)

(72) Inventors: Keigo Fukunishi, Akashi (JP); Shuji Kameyama, Himeji (JP); Tatsuya Karaki, Kako-gun (JP)

(73) Assignee: NORITZ CORPORATION, Hyogo (JP)

( * ) Notice: Subject to any disclaimer, the term of this patent is extended or adjusted under 35 U.S.C. 154(b) by 142 days.

(21) Appl. No.: 14/830,458

(22) Filed: Aug. 19, 2015

(65) Prior Publication Data

US 2016/0069587 A1 Mar. 10, 2016

(30) Foreign Application Priority Data

Sep. 9, 2014 (JP) ..... 2014-183454

(51) Int. Cl.
*F24H 1/12* (2006.01)
*F24H 1/18* (2006.01)
*F23L 17/00* (2006.01)

(52) U.S. Cl.
CPC ..... *F24H 1/124* (2013.01); *F23L 17/005* (2013.01); *F24H 1/186* (2013.01)

(58) Field of Classification Search
CPC ..... F04D 29/42; F04D 29/422
(Continued)

(56) References Cited

U.S. PATENT DOCUMENTS 5,228,413 A * 7/1993 Tam ..... F24H 1/48 122/15.1
6,398,512 B2 * 6/2002 Stewart ..... F04D 25/082 417/53

(Continued)

FOREIGN PATENT DOCUMENTS

JP 57-87555 A 6/1982
JP 60-182399 A 9/1985

(Continued)

OTHER PUBLICATIONS

An Office Action; "Notice of Grounds of Rejection," issued by the Japanese Patent Office dated Mar. 15, 2016, which corresponds to Japanese Patent Application No. 2014-183454 and is related to U.S. Appl. No. 14/830,458; with English language translation.

(Continued)

*Primary Examiner* — Gregory A Wilson
(74) *Attorney, Agent, or Firm* — Studebaker & Brackett PC

(57) ABSTRACT

A fan assembly includes a fan and an emission connection portion. The fan includes a fan case having a first internal space, an impeller, and a rotation shaft. The emission connection portion includes a connection portion case having a second internal space and provided with an emission port for emitting gas sent from the fan to the outside of the fan assembly through the second internal space. In a plan view from a direction of axis of the rotation shaft, a tongue portion extending from one end toward the other end is located at a boundary between the first internal space and the second internal space, and the tongue portion is provided to extend to a position at least reaching a straight line connecting a center point of the emission port and a center of rotation of the rotation shaft to each other, from one end toward the other end.

11 Claims, 11 Drawing Sheets

(58) Field of Classification Search
USPC ..... 122/15.1, 18.1, 18.3; 415/119, 204, 206
See application file for complete search history.

(56) References Cited

U.S. PATENT DOCUMENTS

| | | | | |
|---|---|---|---|---|
| 6,530,346 | B1 * | 3/2003 | Coones | F04D 29/4253 122/4 R |
| 7,354,244 | B2 * | 4/2008 | Hasbargen | F23L 17/005 415/212.1 |
| 7,363,882 | B2 * | 4/2008 | Brown | F24H 8/006 122/14.2 |
| 8,616,158 | B2 * | 12/2013 | Garrett | F04D 29/441 122/18.31 |
| 8,813,689 | B2 * | 8/2014 | Claussen | F04D 17/04 122/235.29 |
| 2002/0131861 | A1 * | 9/2002 | Sakai | F04D 29/422 415/204 |
| 2002/0150478 | A1 | 10/2002 | Aoki | |
| 2010/0226766 | A1 * | 9/2010 | Eguchi | F04D 29/422 415/206 |
| 2011/0044808 | A1 * | 2/2011 | Claussen | F04D 17/04 415/206 |
| 2012/0045338 | A1 * | 2/2012 | Tadokoro | F04D 29/30 416/196 R |
| 2015/0275915 | A1 * | 10/2015 | Rendel | F04D 17/10 415/206 |

FOREIGN PATENT DOCUMENTS

| | | | |
|---|---|---|---|
| JP | S60-186617 | A | 9/1985 |
| JP | 61-149798 | | 9/1986 |
| JP | 62-98148 | A | 5/1987 |
| JP | H05-10299 | A | 1/1993 |
| JP | 2002-339899 | A | 11/2002 |
| JP | 2002-371997 | | 12/2002 |
| JP | 2005-002918 | A | 1/2005 |
| JP | 2005-291049 | A | 10/2005 |

OTHER PUBLICATIONS

An Office Action issued by the Japanese Patent Office dated Oct. 27, 2015, which corresponds to Japanese Patent Application No. 2014-183454 and is related to U.S. Appl. No. 14/830,458; with English language translation.

* cited by examiner

– Prior Art –

FAN ASSEMBLY AND WATER HEATER

BACKGROUND OF THE INVENTION

Field of the Invention

The present invention relates to a fan assembly and a water heater and particularly to a fan assembly and a water heater which can be reduced in size.

Description of the Background Art

In replacement of an already placed tank water heater with an instantaneous water heater, there are locations where an already placed exhaust pipe (a B vent) cannot be removed from a point of view of maintaining appearance of buildings.

At such a location, a water heater can be replaced by leaving the already placed exhaust pipe and inserting an exhaust tube (a flexible exhaust tube) in the exhaust pipe. The exhaust tube should be smaller in diameter, because the exhaust tube cannot be placed in the exhaust pipe if the exhaust tube has a large outer diameter. In order to maintain a stable combustion state even when the exhaust tube is decreased in diameter, an exhaust suction and combustion system should be adopted for a water heater.

A water heater adapted to this exhaust suction and combustion system is disclosed, for example, in Japanese Patent Laying-Open No. 60-186617. In the water heater described in this publication, a heat exchanger for recovering sensible heat, a heat exchanger for recovering latent heat, and a fan are arranged in this order on a downstream side in a flow of combustion gas produced in a burner. Namely, in the water heater of this type, the fan is arranged downstream of the heat exchanger for recovering latent heat in the flow of combustion gas.

A centrifugal fan is available as a fan made use of in a water heater. For example, Japanese Patent Laying-Open No. 2005-291049 discloses a fan in which an impeller is accommodated in a fan case. In such a fan, the fan case mainly has a suction port opening in a direction of a rotation shaft of the impeller, an emission port opening in an outer circumferential direction of a blade, and a tongue portion. According to such a structure, as the impeller rotates, gas such as air is suctioned through the suction port and suctioned gas is emitted through the emission port.

In mounting the fan described above on a water heater adapted to an exhaust suction and combustion system, the fan case and the exhaust tube described above are connected to each other through the emission port. In order to reduce a size of such a water heater, the fan and components therearound should be reduced in size by providing the fan and the exhaust tube at positions in proximity to each other in a plan view from a direction of axis of the rotation shaft of the fan.

As a result of review by the present inventors, however, it has been found that blowing capability of the fan lowers when the fan case is designed simply such that the fan and the exhaust tube are proximate to each other in the water heater adapted to the exhaust suction and combustion system.

SUMMARY OF THE INVENTION

The present invention was made in view of the problems above, and an object thereof is to provide a fan assembly and a water heater which can be reduced in size without lowering blowing capability of a fan.

A fan assembly according to the present invention is a fan assembly for sending gas, and includes a fan and an emission connection portion. The fan includes a fan case having a first internal space, an impeller accommodated in the first internal space, a drive source for driving the impeller, and a rotation shaft coupling the impeller and the drive source to each other. The emission connection portion includes a connection portion case having a second internal space and provided with an emission port for emitting gas sent from the fan to the outside of the fan assembly through the second internal space. In the fan assembly, in a plan view from a direction of axis of the rotation shaft, a tongue portion is located at a boundary between the first internal space and the second internal space, and the tongue portion is provided to extend to a position at least reaching a virtual straight line connecting a center point of the emission port and a center of rotation of the rotation shaft to each other, from one end of the boundary toward the other end of the boundary.

In order to reduce a size of a fan assembly by bringing a fan and an exhaust tube connected to an emission port closer to each other, the present inventors have designed the fan assembly such that an emission connection portion provided with the emission port is connected to a fan case and the emission port is located in the vicinity of a boundary between a first internal space in the fan case and a second internal space in the emission connection portion, and continued studies. Consequently, the present inventors have found that a backflow occurs around a tongue portion extending from one end toward the other end of the boundary. By further continuing dedicated studies in order to suppress this backflow, the present inventors have conceived that the backflow around the tongue portion can be suppressed by providing the tongue portion extending from one end toward the other end of the boundary between the first internal space and the second internal space to extend to a position at least reaching a straight line connecting the center point of the emission port and the center of rotation of the rotation shaft to each other.

Therefore, according to the fan assembly in the present invention, a backflow caused due to the emission port being located in the vicinity of the fan can be suppressed. Therefore, lowering in blowing capability of the fan can be suppressed and hence the fan assembly can be reduced in size without lowering in blowing capability of the fan.

In the fan assembly, in the plan view from the direction of axis of the rotation shaft, a tip end portion of the tongue portion on a side of the other end is located either on a common external tangent of virtual tangents in contact with an outer circumferential portion of the emission port and an outer circumferential portion of the impeller, of which position crossing the boundary is closest to the other end of the boundary, or on a side of one end relative to the common external tangent.

Thus, exhaust resistance in sending gas from the first internal space to the second internal space can be suppressed. Therefore, lowering in blowing capability of the fan can be suppressed and hence the fan assembly can be reduced in size without lowering in blowing capability of the fan.

In the fan assembly above, in the plan view from the direction of axis of the rotation shaft, the tongue portion is located either on a common internal tangent of virtual tangents in contact with an outer circumferential portion of the emission port and an outer circumferential portion of the impeller, which comes closer to one end from a side of the other end of the boundary, from a side in contact with the outer circumferential portion of the impeller toward a side in contact with the outer circumferential portion of the emission port, or on a side of one end relative to the common internal tangent.

Thus, exhaust resistance in sending gas from the first internal space to the second internal space can further be suppressed. Therefore, lowering in blowing capability of the fan can be suppressed and hence the fan assembly can be reduced in size without lowering in blowing capability of the fan.

In the fan assembly, in the plan view from the direction of axis of the rotation shaft, an opposing wall portion of the tongue portion opposed to an outer circumferential portion of the impeller has a linear region extending linearly from a side of the other end toward one end and a curved region located on a side of one end relative to the linear region and continuing to the linear region. In the linear region of this tongue portion, a distance between the opposing wall portion of the tongue portion and the outer circumferential portion of the impeller decreases from the side of the other end toward one end.

Thus, since pressure fluctuation caused between the tongue portion and the impeller can be mitigated, NZ noise produced from the fan assembly can be lowered.

In the fan assembly, the fan case and the connection portion case are integrally formed. Thus, emission of gas from a fan side toward the emission connection portion is smoother.

A water heater according to the present invention includes a combustion portion which generates combustion gas, a heat exchanger which heats water which flows through inside, through heat exchange with combustion gas, and the fan assembly described above which is located downstream of the heat exchanger in a flow of combustion gas and suctions combustion gas which has passed through the heat exchanger and emits combustion gas to the outside of the water heater.

The water heater according to the present invention is a water heater of an exhaust suction type. With this water heater, the fan assembly and components therearound can be reduced in size and hence the water heater can be reduced in size.

A water heater according to the present invention includes a combustion portion which generates combustion gas, a heat exchanger which heats water which flows through inside, through heat exchange with combustion gas, and the fan assembly described above which is located upstream of the combustion portion in a flow of combustion gas and sends gas to the combustion portion.

The water heater according to the present invention is a water heater of a forced type. With this water heater, the fan assembly and components therearound can be reduced in size and hence the water heater can be reduced in size.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be described hereinafter with reference to the drawings.

First Embodiment (Structure of Water Heater and Fan Assembly)

A water heater 100 including a fan assembly 1 in the present embodiment will be described mainly with reference to FIGS. 1 to 6. Water heater 100 is a water heater of a latent heat recovery type adapted to an exhaust suction and combustion system.

Figure 1:
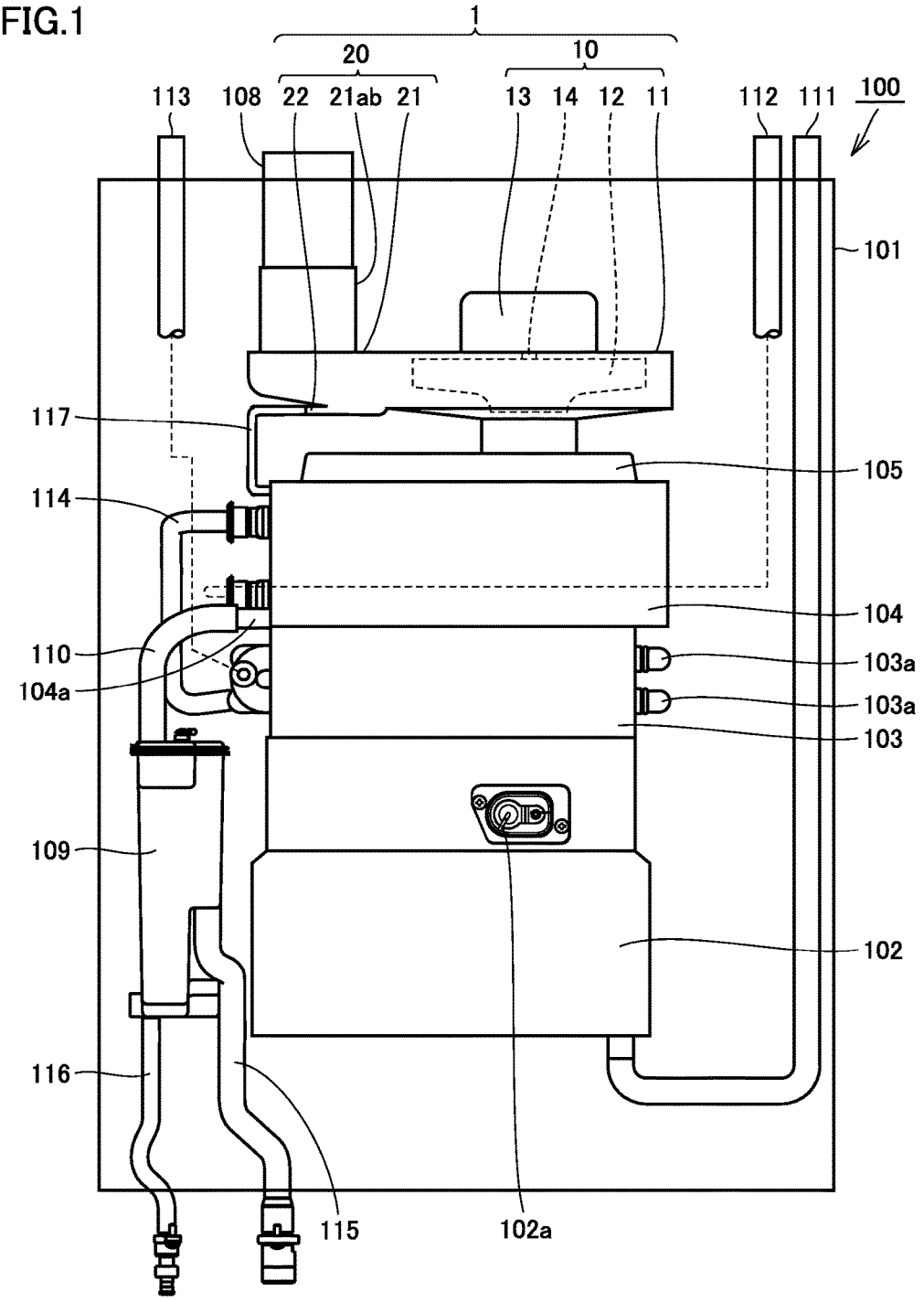
FIG. 1 is a front view schematically showing a structure of a water heater in one embodiment of the present invention.

Referring mainly to FIG. 1, water heater 100 mainly has a housing 101, a burner 102, a primary heat exchanger 103, a secondary heat exchanger 104, an exhaust box 105, fan assembly 1, a connection pipe 108, a drainage water tank 109, and pipes 110 to 116.

Burner 102 serves to produce combustion gas by burning fuel gas. A gas supply pipe 111 is connected to burner 102. This gas supply pipe 111 serves to supply fuel gas to burner 102. A gas valve (not shown) implemented, for example, by an electromagnetic valve is attached to this gas supply pipe 111.

A spark plug 102*a* is arranged above burner 102. This spark plug 102*a* serves to ignite an air fuel mixture injected from burner 102 to thereby produce a flame, by generating sparks between the plug and a target (not shown) provided in burner 102. Burner 102 generates a quantity of heat by burning fuel gas supplied from gas supply pipe 111 (which is called a combustion operation).

Figure 2:
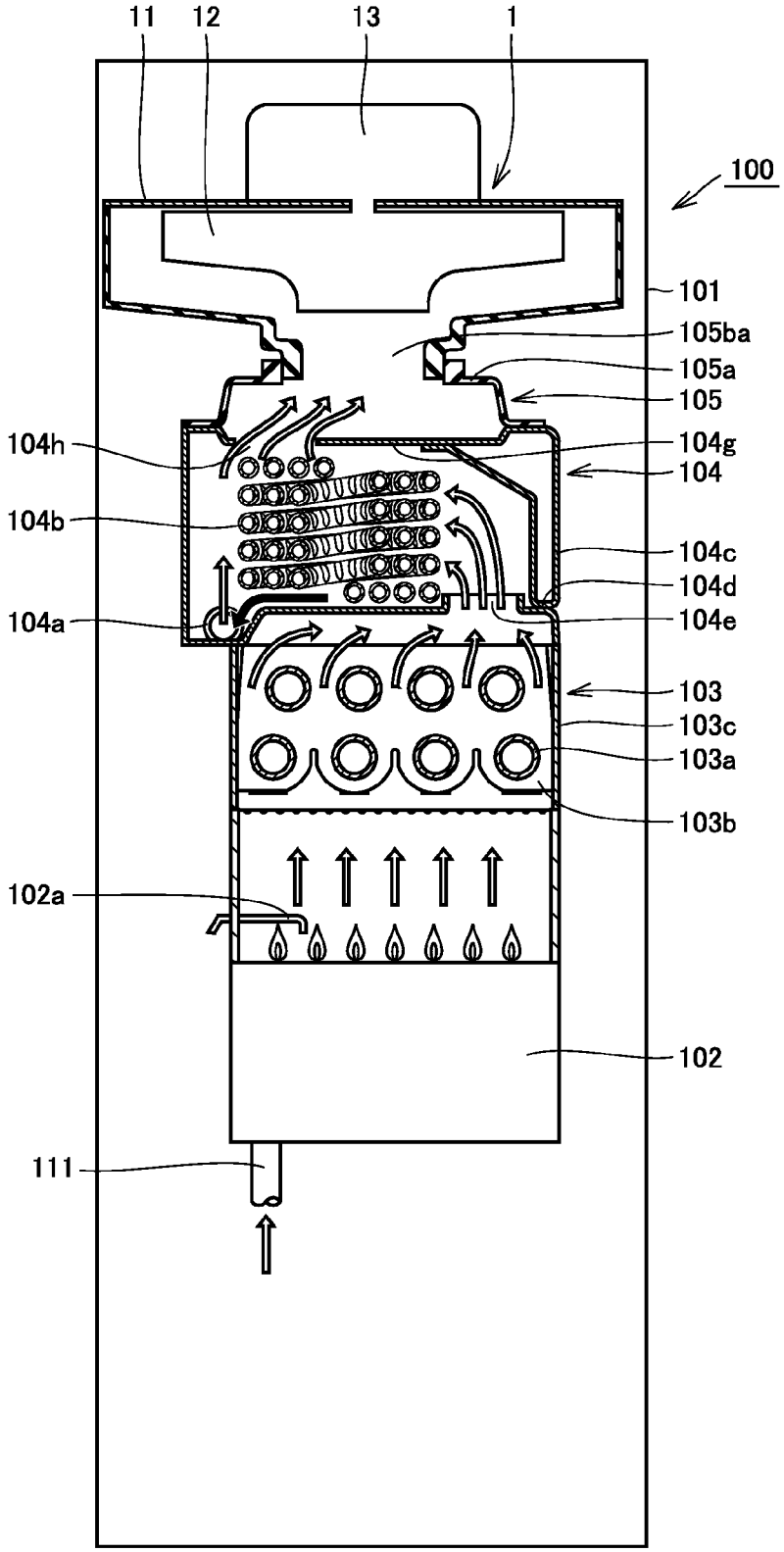
FIG. 2 is a partial cross-sectional side view schematically showing the structure of the water heater shown in FIG. 1.

Referring mainly to FIG. 2, primary heat exchanger 103 is a heat exchanger of a sensible heat recovery type. This primary heat exchanger 103 mainly has a plurality of plate-shaped fins 103*b*, a heat conduction pipe 103*a* penetrating the plurality of plate-shaped fins 103*b*, and a case 103*c* accommodating fins 103*b* and heat conduction pipe 103*a*. Primary heat exchanger 103 exchanges heat with combustion gas generated by burner 102, and specifically, it serves to heat water which flows through heat conduction pipe 103*a* of primary heat exchanger 103 with the quantity of heat generated as a result of the combustion operation of burner 102.

Referring mainly to FIG. 2, secondary heat exchanger 104 is a heat exchanger of a latent heat recovery type. This secondary heat exchanger 104 is located downstream of primary heat exchanger 103 in a flow of combustion gas and connected in series with primary heat exchanger 103. Since water heater 100 according to the present embodiment thus has secondary heat exchanger 104 of a latent heat recovery type, it is a water heater of the latent heat recovery type.

Secondary heat exchanger 104 mainly has a drainage water discharge port 104*a*, heat conduction pipes 104*b*, a sidewall 104*c*, a bottom wall 104*d*, and an upper wall 104*g*. Heat conduction pipes 104*b* are layered as they are helically wound. Sidewall 104*c*, bottom wall 104*d*, and upper wall 104*g* are arranged to surround heat conduction pipes 104*b*.

In secondary heat exchanger 104, water which flows through heat conduction pipes 104*b* are pre-heated (heated) through heat exchange with combustion gas of which heat has been exchanged in primary heat exchanger 103. As a temperature of combustion gas is lowered to approximately 60° C. through this process, moisture contained in combustion gas is condensed so that latent heat can be obtained. In addition, latent heat is recovered in secondary heat exchanger 104 and moisture contained in combustion gas is condensed, whereby drainage water is produced.

Bottom wall 104*d* serves as a partition between primary heat exchanger 103 and secondary heat exchanger 104, and it also serves as an upper wall of primary heat exchanger 103. This bottom wall 104*d* is provided with an opening portion 104*e*, and this opening portion 104*e* allows communication between a space where heat conduction pipe 103*a* of primary heat exchanger 103 is arranged and a space where heat conduction pipes 104*b* of secondary heat exchanger 104 are arranged. As shown with hollow arrows in FIG. 2, combustion gas can flow from primary heat exchanger 103 to secondary heat exchanger 104 through opening portion 104*e*. In this embodiment, for the sake of simplification, bottom wall 104*d* of secondary heat exchanger 104 and the upper wall of primary heat exchanger 103 are common, however, an exhaust collection and guide member may be connected between primary heat exchanger 103 and secondary heat exchanger 104.

Upper wall 104*g* is provided with an opening portion 104*h*, and this opening portion 104*h* allows communication between the space where heat conduction pipes 104*b* of secondary heat exchanger 104 are arranged and an internal space in exhaust box 105. As shown with hollow arrows in FIG. 2, combustion gas can flow from secondary heat exchanger 104 into the internal space in exhaust box 105 through opening portion 104*h*.

Drainage water discharge port 104*a* is provided in sidewall 104*c* or bottom wall 104*d*. This drainage water discharge port 104*a* opens at a lowest position in the space surrounded by sidewall 104*c*, bottom wall 104*d*, and upper wall 104*g* (a lowermost position in a vertical direction in a state of placement of the water heater), which is lower than a lowermost portion of heat conduction pipes 104*b*. Thus, drainage water produced in secondary heat exchanger 104 can be guided to drainage water discharge port 104*a* along bottom wall 104*d* and sidewall 104*c* as shown with a black arrow in FIG. 2.

Figure 3:
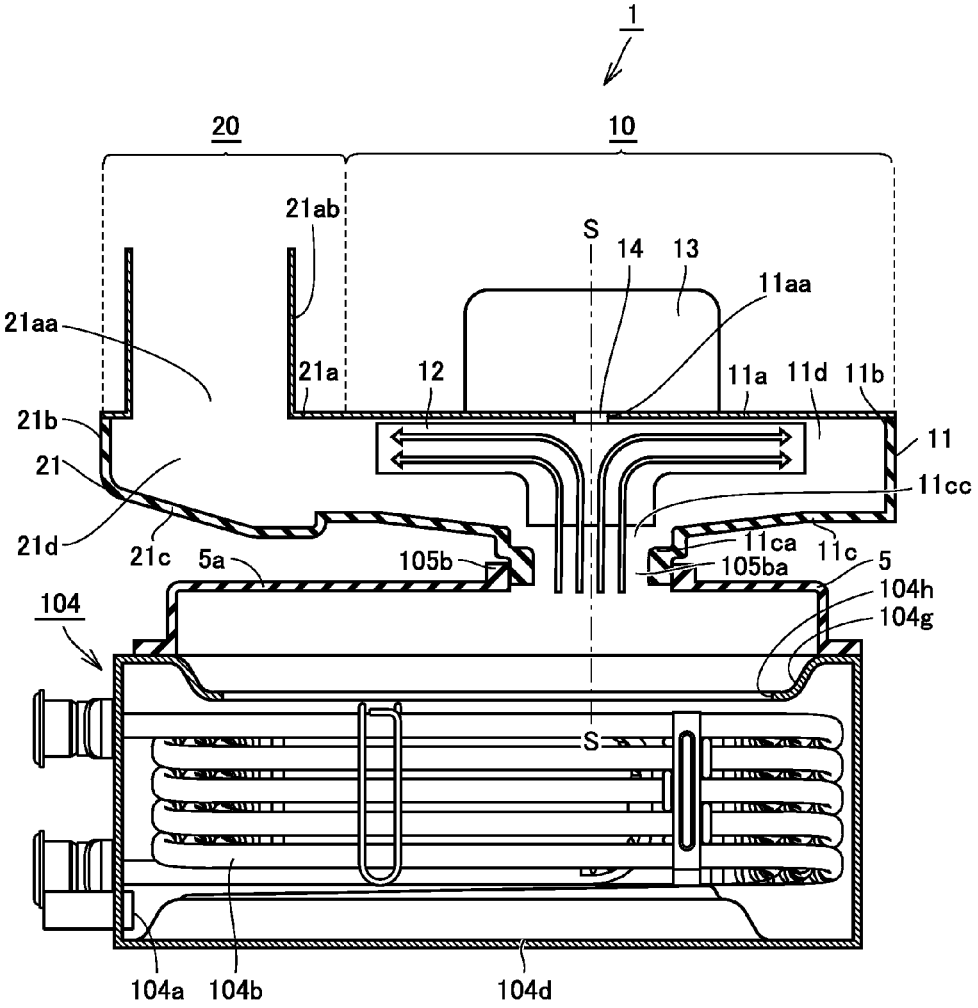
FIG. 3 is a partial cross-sectional view showing a fan assembly and a secondary heat exchanger in an enlarged manner, in the water heater shown in FIG. 1.

Referring mainly to FIGS. 2 and 3, exhaust box 105 forms a path for a flow of combustion gas between secondary heat exchanger 104 and fan assembly 1. This exhaust box 105 can guide combustion gas of which heat has been exchanged in secondary heat exchanger 104 to fan assembly 1. Exhaust box 105 is attached to secondary heat exchanger 104 and located downstream of secondary heat exchanger 104 in the flow of combustion gas.

Exhaust box 105 mainly has a box main body 105*a* and a fan connection portion 105*b*. An internal space in box main body 105*a* communicates with the internal space where heat conduction pipes 104*b* of secondary heat exchanger 104 are arranged through opening portion 104*h* in secondary heat exchanger 104. Fan connection portion 105*b* is provided so as to protrude from an upper portion of box main body 105*a*. This fan connection portion 105*b* has, for example, a cylindrical shape, and an internal space 105*ba* thereof communicates with the internal space in box main body 105*a*.

Referring mainly to FIG. 1, drainage water tank 109 serves to store drainage water produced in secondary heat exchanger 104, and this drainage water tank 109 and drainage water discharge port 104*a* of secondary heat exchanger 104 are connected to each other through a drainage water discharge pipe 110. Acid drainage water stored in drainage water tank 109 is temporarily stored, for example, in an internal space in drainage water tank 109 and thereafter, normally, it is discharged through drainage water discharge piping 115 to the outside of water heater 100.

A lower portion of drainage water tank 109 is connected to drainage water drain piping 116 separately from drainage water discharge piping 115. This drainage water drain piping 116 (which is normally closed) is designed so as to be able to discharge drainage water within drainage water tank 109 which cannot be discharged through drainage water discharge piping 115, by opening drainage water drain piping 116 during maintenance. The internal space in drainage water tank 109 may be filled with a neutralization agent (not shown) for neutralizing acid drainage water.

Referring mainly to FIG. 1, gas supply pipe 111 is connected to burner 102. A water supply pipe 112 is connected to heat conduction pipes 104*b* (see FIG. 2) of secondary heat exchanger 104 and a hot water delivery pipe 113 is connected to heat conduction pipe 103*a* (see FIG. 2) of primary heat exchanger 103. Heat conduction pipe 103*a* of primary heat exchanger 103 and heat conduction pipes 104*b* of secondary heat exchanger 104 are connected to each other through connection piping 114. Each of gas supply pipe 111, water supply pipe 112, and hot water delivery pipe 113 leads to the outside, for example, in a top portion of water heater 100.

Referring mainly to FIG. 3, in the present embodiment, fan assembly 1 serves to emit combustion gas (of which heat has been exchanged in secondary heat exchanger 104) which has passed through secondary heat exchanger 104 to the outside of water heater 100 by suctioning combustion gas.

Namely, fan assembly 1 is located downstream of exhaust box 105 and secondary heat exchanger 104 in the flow of combustion gas. Namely, in water heater 100, burner 102, primary heat exchanger 103, secondary heat exchanger 104, exhaust box 105, and fan assembly 1 are disposed in this order from upstream to downstream in the flow of combustion gas produced in burner 102. Since combustion gas is suctioned and exhausted by means of fan assembly 1 in this arrangement, water heater 100 in the present embodiment is the water heater adapted to the exhaust suction and combustion system.

Referring mainly to FIG. 1, one end of connection pipe 108 is connected to an emission connection portion 20 of fan assembly 1. The other end of connection pipe 108 is connected to the exhaust tube (not shown) for guiding combustion gas of water heater 100 to the outside (for example, outdoors). Therefore, combustion gas sent from fan assembly 1 can be emitted to the outside of water heater 100 through connection pipe 108. The exhaust tube is, for example, an exhaust tube (not shown) introduced in an already-provided exhaust pipe.

Figure 4:
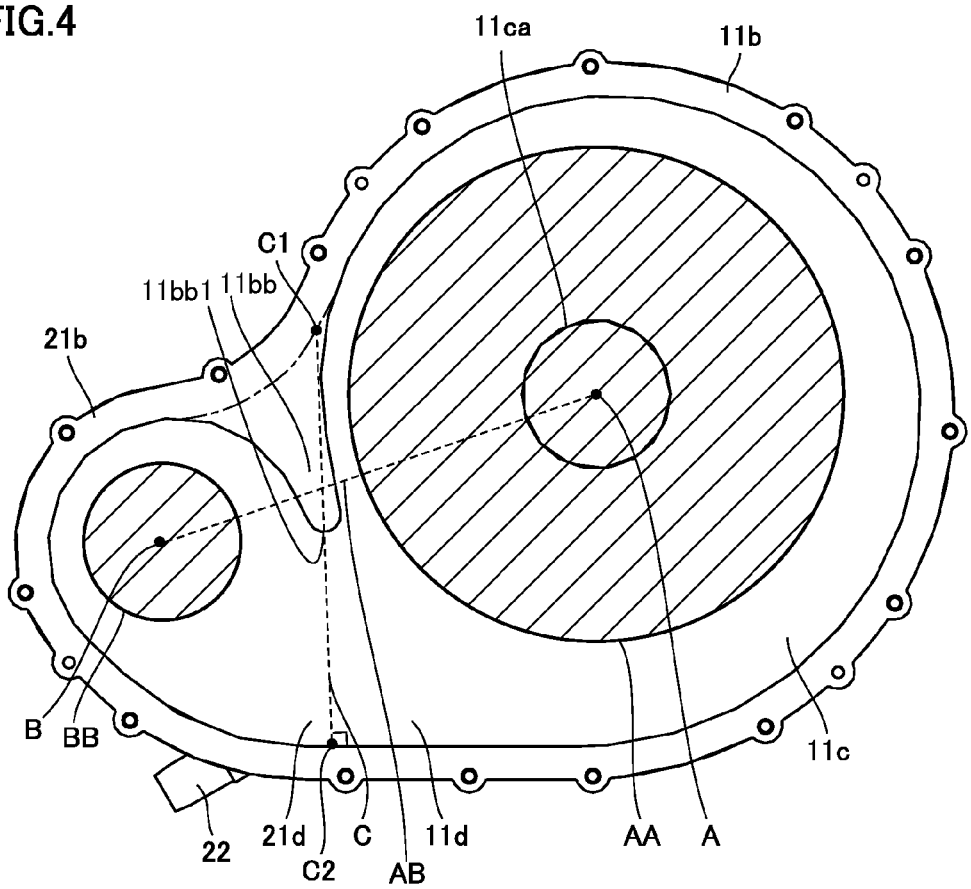
FIG. 4 is a top view showing positional relation among a tongue portion, an impeller, and an emission port in a plan view from a direction of axis of a rotation shaft of the fan assembly shown in FIG. 1, and a schematic diagram for illustrating a straight line AB.

Referring mainly to FIGS. 3 and 4, fan assembly 1 mainly includes a fan 10 and emission connection portion 20 connected to fan 10.

Fan 10 serves to suction gas such as air or combustion gas and to emit gas in a prescribed direction, and mainly has a fan case 11, an impeller 12, a drive source 13, and a rotation shaft 14. In the water heater adapted to the exhaust suction and combustion system, fan 10 mainly suctions combustion gas.

Fan case 11 mainly has a top wall 11*a*, a circumferential wall 11*b*, a bottom wall 11*c*, and a tongue portion 11*bb*. A through hole 11*aa* is provided in top wall 11*a*, through which rotation shaft 14 connecting impeller 12 accommodated in an internal space (a first internal space) 11*d* in fan case 11 and drive source 13 arranged outside fan case 11 to each other passes. Circumferential wall 11*b* is arranged to surround an outer circumference of impeller 12 accommodated in internal space 11*d* in fan case 11.

A suction port 11*cc* is provided in bottom wall 11*c* of fan case 11, through which internal space 11*d* in fan case 11 and the internal space in exhaust box 105 (internal space 105*ba* in fan connection portion 105*b*) communicate with each other. Thus, as shown with hollow arrows in FIG. 3, combustion gas can be suctioned from box main body 105*a* of exhaust box 105 through fan connection portion 105*b* into fan case 11. Bottom wall 11*c* of fan case 11 may have, for example, a cylindrical protruding portion 11*ca*. In this case, connection with fan connection portion 105*b* is facilitated.

Impeller 12 is accommodated in fan case 11. This impeller 12 is connected to drive source 13 with rotation shaft 14 being interposed. Thus, impeller 12 can rotate around rotation shaft 14 by being provided with driving force from drive source 13. With rotation of impeller 12, as shown with the hollow arrows in the figure, gas on a side of exhaust box 105 is suctioned toward an inner circumference of impeller 12 and sent toward the outer circumference of the impeller. A chain dotted line S in the figure indicates a direction of axis of rotation shaft 14.

Emission connection portion 20 serves to guide combustion gas sent by fan 10 to the outside of fan assembly 1, that is, connection pipe 108 in the present embodiment, and it is located downstream of fan 10 in a path for flow of combustion gas. Namely, in water heater 100, burner 102, primary heat exchanger 103, secondary heat exchanger 104, exhaust box 105, fan 10 of fan assembly 1, emission connection portion 20 of fan assembly 1, and connection pipe 108 are disposed in this order from upstream to downstream in a flow of combustion gas produced in burner 102.

Emission connection portion 20 includes a connection portion case 21 having an internal space 21*d* (a second internal space). Connection portion case 21 mainly has a top wall 21*a*, a circumferential wall 21*b*, and a bottom wall 21*c*, and internal space 21*d* in connection portion case 21 (the internal space in emission connection portion 20) and internal space 11*d* in fan case 11 (the internal space in fan 10) communicate with each other.

Top wall 21*a* of connection portion case 21 is provided with an emission port 21*aa* for emitting combustion gas sent from a side of fan 10 (internal space 11*d* in fan case 11) to the outside of water heater 100. In order to facilitate connection to connection pipe 108, a connection portion 21*ab* having a cylindrical shape may be provided around emission port 21*aa* in top wall 21*a*. Circumferential wall 21*b* is arranged to surround a projection region B of emission port 21*aa* (a hatched region in connection portion case 21 in FIG. 4) in a plan view (FIG. 4) of emission connection portion 20 from the direction of axis of rotation shaft 14 of fan 10.

Thus, combustion gas sent out of internal space 11*d* in fan 10 is guided toward circumferential wall 21*b* of emission connection portion 20, diverted to tumble in internal space 21*d*, and consequently emitted to the outside of fan assembly 1 through emission port 21*aa*.

Emission connection portion 20 may further have a drainage water discharge portion 22. Drainage water discharge portion 22 serves to discharge drainage water downstream of fan 10 in the path for flow of combustion gas. Drainage water discharge portion 22 is preferably connected to secondary heat exchanger 104 through a coupling pipe 117 (see FIG. 1). Thus, internal space 21*d* in emission connection portion 20 and an internal space in secondary heat exchanger 104 communicate with each other through drainage water discharge portion 22 and coupling pipe 117, so that drainage water downstream of fan 10 in the path for flow of combustion gas can be discharged into secondary heat exchanger 104.

In the present embodiment, fan case 11 and connection portion case 21 are integrally formed. Specifically, circumferential wall 11*b* and bottom wall 11*c* of fan case 11 and circumferential wall 21*b* and bottom wall 21*c* of connection portion case 21 are integrally formed, and top wall 11*a* of fan case 11 and top wall 21*a* of connection portion case 21 are integrally formed.

Tongue portion 11*bb* extends between internal space 11*d* in fan case 11 and internal space 21*d* in connection portion case 21. A specific structure of this tongue portion 11*bb* will be described with reference to FIGS. 4 to 6.

Initially, in order to facilitate understanding of a position of tongue portion 11*bb*, a boundary between fan 10 and emission connection portion 20 will be described with reference to FIG. 4.

FIG. 4 shows internal space 11*d* in fan case 11, internal space 21*d* in connection portion case 21, and tongue portion 11*bb*. Furthermore, FIG. 4 shows a region AA in fan case 11 where impeller 12 is arranged and a region BB which is a projection region of emission port 21*aa* in the plan view from the direction of axis of rotation shaft 14 so as to facilitate understanding of positional relation among tongue portion 11*bb*, impeller 12, and emission port 21*aa*.

Referring to FIG. 4, the boundary between fan 10 and emission connection portion 20 is shown with a dotted line C in the plan view of fan assembly 1 in the direction of axis of rotation shaft 14. This dotted line C is a straight line which is orthogonal to a wall surface opposed to a tip end portion 11*bb*1 of tongue portion 11*bb* and passes through tip end portion 11*bb*1 of tongue portion 11*bb*. A portion on the right of boundary C in the figure with this dotted line C being defined as boundary C is a portion substantially functioning as the fan. In the wall surface opposed to tongue portion 11*bb*, circumferential wall 11*b* of fan case 11 and circumferential wall 21*b* of connection portion case 21 are linearly connected to each other.

A portion substantially functioning as the fan is herein denoted as "fan 10". A portion located downstream of "fan 10" and adjacent to "fan 10" with boundary C being defined as the boundary is denoted as "emission connection portion 20." Namely, internal space 11*d* in fan 10 (internal space 11*d* in fan case 11) and internal space 21*d* in emission connection portion 20 (internal space 21*d* in connection portion case 21) are connected to each other with boundary C lying therebetween.

A structure of tongue portion 11*bb* will now be described with reference to boundary C, region AA, and region BB described above.

Referring to FIG. 4, with boundary C described above being defined as the boundary between fan 10 and emission connection portion 20, tongue portion 11*bb* is located to extend from one end C1 of boundary C toward the other end C2 thereof. In the plan view from the direction of axis of rotation shaft 14, tip end portion 11*bb*1 of tongue portion 11*bb* is in an arc shape and tongue portion 11*bb* decreases in width from one end C1 of boundary C toward the other end C2. Here, a region extending from a region shown with the chain dotted line in FIG. 4 to tip end portion 11*bb*1 is defined as tongue portion 11*bb*.

Tongue portion 11*bb* is provided to extend to a position at least reaching a straight line AB connecting a center point B of region BB and a center point A of region AA to each other. Center point B of region BB matches with the center point of region BB which is the projection region of emission port 21*aa*. Center point A of region AA matches with the center point of region AA which is a region where impeller 12 is arranged and matches with the center of rotation of impeller 12, that is, the center of rotation of rotation shaft 14.

"Being provided to extend to a position at least reaching straight line AB" means that tip end portion 11*bb*1 of tongue portion 11*bb* should only reach straight line AB and may be provided to extend beyond straight line AB, and does not encompass a case that tip end portion 11*bb*1 does not reach straight line AB.

Figure 5:
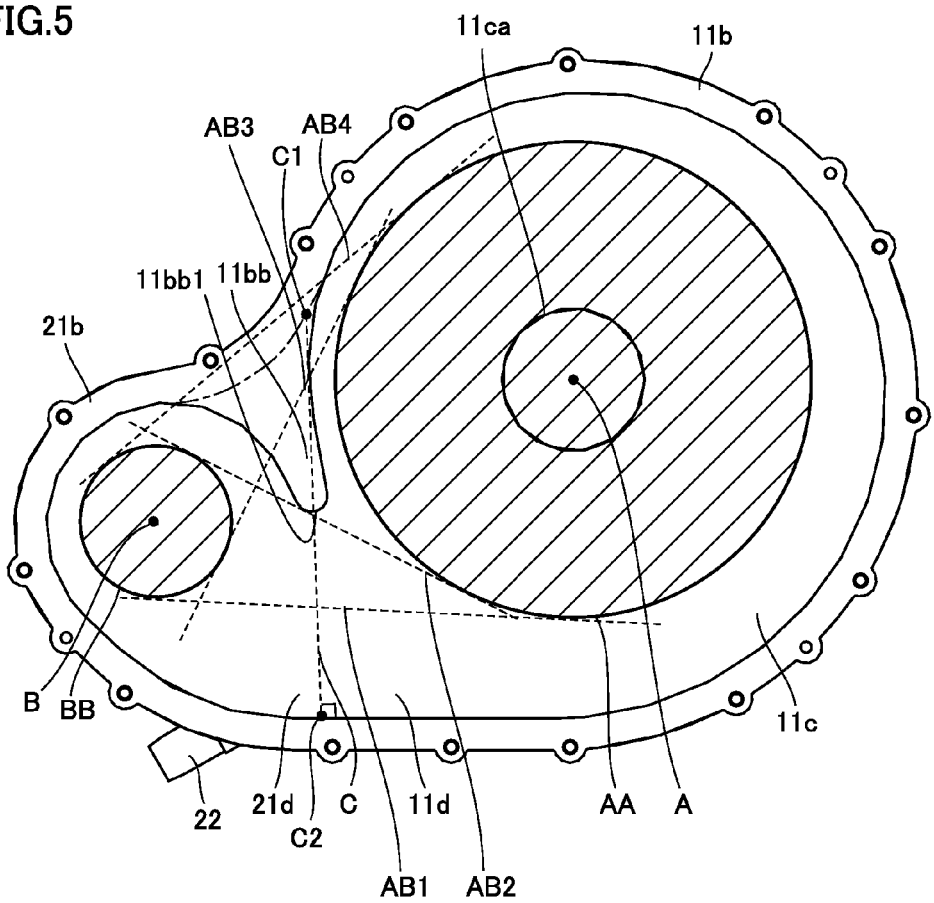
FIG. 5 is a top view showing positional relation among the tongue portion, the impeller, and the emission port in the plan view from the direction of axis of the rotation shaft of the fan assembly shown in FIG. 4, and a schematic diagram for illustrating tangents AB1 to AB4.

Referring to FIG. 5, tip end portion 11*bb*1 of tongue portion 11*bb* is located either on a tangent AB1 (a common external tangent) of virtual tangents AB1 to AB4 in contact with the outer circumferential portion of region BB and the outer circumferential portion of region AA, or on a side of one end C1 relative to tangent AB1. Namely, tongue portion 11*bb* is provided to extend such that tip end portion 11*bb*1 does not go beyond tangent AB1. Furthermore, tip end portion 11*bb*1 of tongue portion 11*bb* may be located either on tangent AB2 (a common internal tangent) or on the side of one end C1 relative to tangent AB2.

As is understood from FIG. 5, tangent AB1 of tangents AB1 to AB4 is the common external tangent of which position crossing boundary C is closest to the other end of boundary C, and tangent AB2 is the common internal tangent which comes closer to one end C1 from the other end C2 of boundary C, from a side in contact with the outer circumferential portion of region AA toward a side in contact with the outer circumferential portion of region BB.

Figure 6:
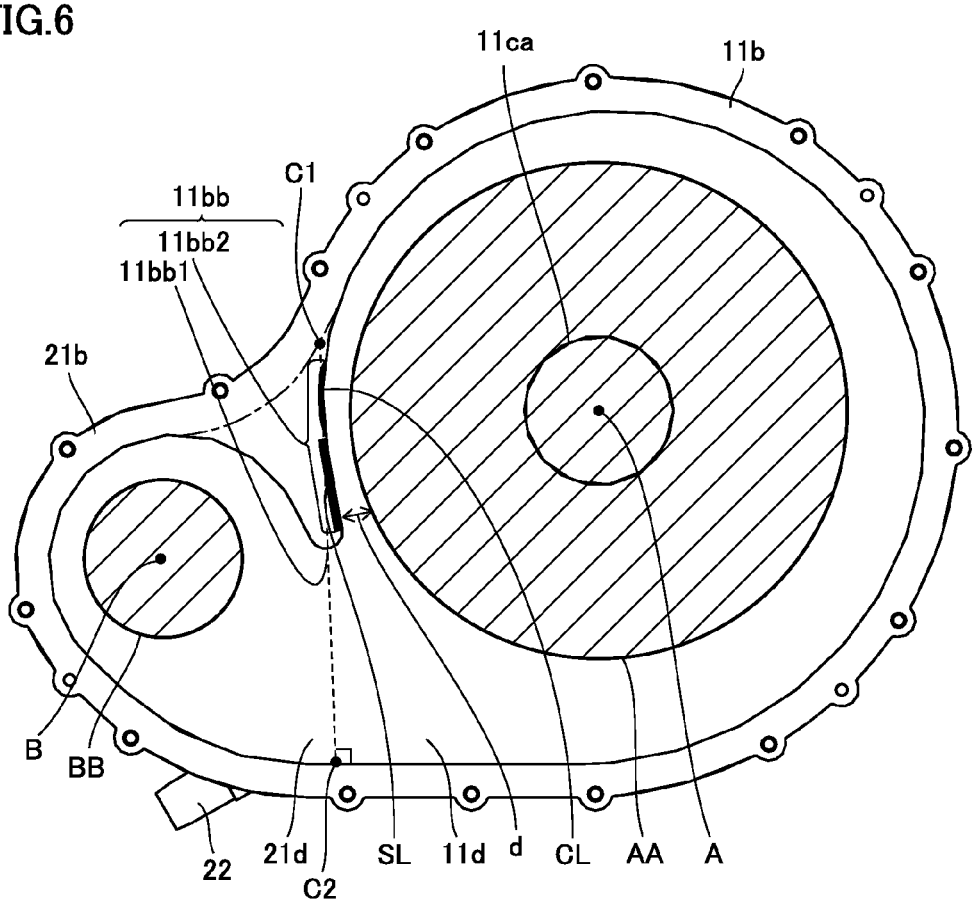
FIG. 6 is a top view schematically showing a structure of the tongue portion of the fan assembly shown in FIG. 1.

Referring to FIG. 6, in the plan view from the direction of axis of rotation shaft 14, an opposing wall portion 11*bb*2 of tongue portion 11*bb* which is a surface opposed to the outer circumferential portion of the impeller (that is, the outer circumferential portion of region AA) is structured as follows.

In the plan view from the direction of axis of rotation shaft 14, opposing wall portion 11*bb*2 has a linear region SL linearly extending from the side of the other end C2 toward one end C1 and a curved region CL located closer to one end C1 relative to linear region SL and continuing to linear region SL. In this linear region SL, a distance d between opposing wall portion 11*bb*2 and the outer circumferential portion of region AA (the outer circumferential portion of impeller 12) decreases from the side of the other end C2 toward one end C1.

"Distance d between opposing wall portion 11*bb*2 and the outer circumferential portion of region AA" means a distance between region AA and tongue portion 11*bb* in a direction of radius of region AA and "distance decreasing from the side of the other end C2 toward one end C1" means that a gap is narrower from the side of the other end C2 toward one end C1.

A portion of tongue portion 11*bb* opposed to internal space 21*d* preferably has a curved shape as surrounding region BB.

(Function and Effect)

A function and effect of the fan assembly and the water heater in the present embodiment will be described.

For reducing a size of a water heater adapted to an exhaust suction and combustion system incorporating a conventional fan as disclosed in Japanese Patent Laying-Open No. 60-186617, it is possible that a fan assembly and components therearound are reduced in size. Specifically, it is possible that an emission connection portion is connected to a downstream side in a path for combustion in the fan, an emission port provided in the emission connection portion is provided in the vicinity of an impeller in a direction of axis of a rotation shaft of the impeller, and a total length (a lateral direction in FIG. 1) of the fan assembly is decreased.

In order to reduce a size of a water heater incorporating the fan assembly by bringing the fan (the impeller) and an exhaust tube connected to the emission port closer to each other, the present inventors have designed the water heater such that the emission connection portion provided with the emission port is connected to a fan case and the emission port is located in the vicinity of a boundary between an internal space in the fan case and an internal space in the emission connection portion, and continued studies. Consequently, the present inventors have conceived that blowing capability of the fan lowers, and found as a result of further studies that this is caused by a backflow around a tongue portion extending from one end of the boundary toward the other end. Then, the present inventors have considered a cause of this backflow as follows.

Figure 7:
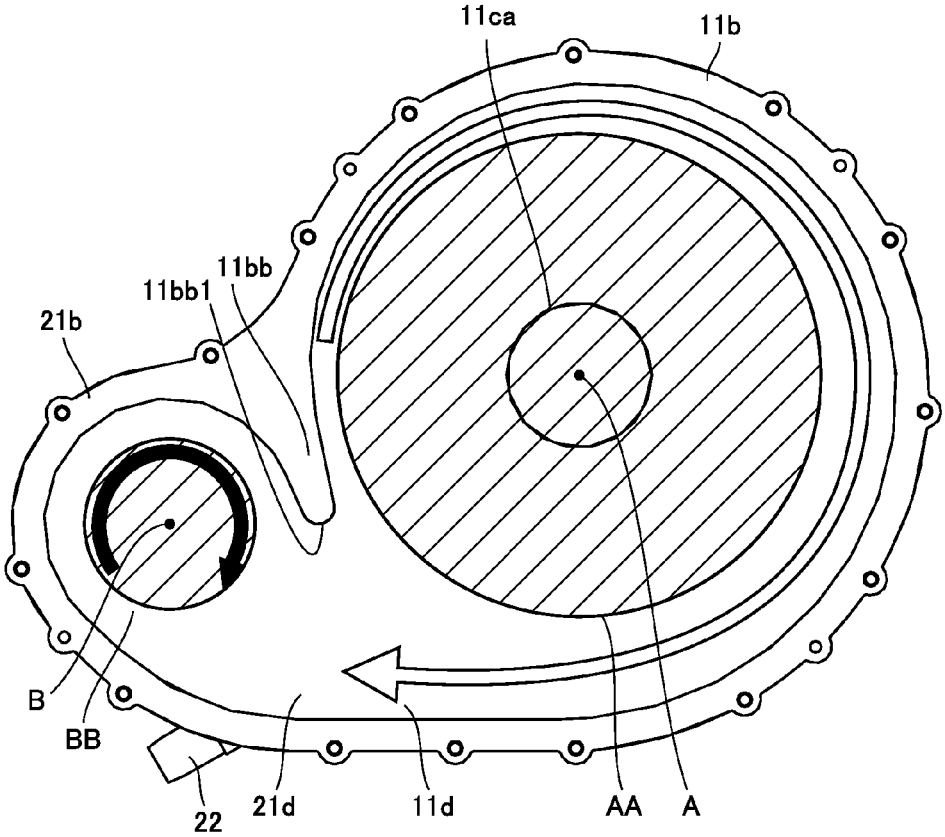
FIG. 7 is a schematic diagram for illustrating a flow of gas generated in an internal space in the fan assembly.

When emission port 21*aa* is designed to be located in a direction substantially perpendicular to a direction of flow of gas sent from impeller 12 in the vicinity of boundary C between internal space 11*d* and internal space 21*d*, a direction of flow of gas sent from fan 10 abruptly changes in internal space 21*d* in emission connection portion 20 as shown in FIG. 7.

Referring to FIG. 7, a flow of gas (a first flow) as shown with a hollow arrow is generated in internal space 11*d*, while a flow (a second flow) as shown with a black arrow is generated in internal space 21*d*. This second flow is a tumble toward emission port 21*aa* located above, and it is a flow higher in velocity than the first flow. When this second flow cannot completely tumble or go up and flows out of a portion in the vicinity of tip end portion 11*bb*1 of tongue portion 11*bb* into internal space 11*d*, a backflow of gas is generated, which results in lowering in blowing capability of the fan.

The present inventors have tracked down the fact that the backflow is caused in the vicinity of tip end portion 11*bb*1 of tongue portion 11*bb* and the cause thereof, and further conducted dedicated studies based on such finding. Then, the present inventors have conceived that the backflow around tip end portion 11*bb*1 of tongue portion 11*bb* can be suppressed by tongue portion 11*bb* extending from one end C1 to the other end C2 of boundary C between internal space 11*d* and internal space 21*d* being provided to extend to a position at least reaching straight line AB connecting the center point of emission port 21*aa* and the center of rotation of rotation shaft 14 to each other in the plan view from the direction of axis of rotation shaft 14. Tongue portion 11*bb* can guide the second flow such that it appropriately tumbles.

In fan assembly 1 according to the present embodiment, tongue portion 11*bb* is provided to extend to the position at least reaching straight line AB connecting center point B of region BB and center point A of region AA to each other. Thus, in spite of the structure that fan 10 and emission port 21*aa* are proximate to each other, the backflow of gas described above can be suppressed. Therefore, fan assembly 1 can be reduced in size without lowering in blowing capability of fan 10 and hence water heater 100 incorporating the same can be reduced in size.

In the present embodiment, a direction in which an area of impeller 12 increases (the lateral direction in FIG. 3) and a two-dimensional direction of a virtual surface including emission port 21*aa* match with each other. Thus, more effective reduction in size can be achieved. With such a structure, a direction in which connection pipe 108 connected to emission port 21*aa* extends can match with the direction of axis of rotation shaft 14 perpendicular to the direction of increase in area of impeller 12, and hence fan assembly 1 and components therearound can further be reduced in size.

In fan assembly 1, tip end portion 11*bb*1 of tongue portion 11*bb* is preferably located either on tangent AB1 of virtual tangents AB1 to AB4 in contact with the outer circumferential portion of region BB and the outer circumferential portion of region AA, or on the side of one end C1 relative to tangent AB1, for a reason below.

When tongue portion 11*bb* is provided to extend excessively long, a pathway around boundary C of gas sent from internal space 11*d* into internal space 21*d* is excessively narrow. Then, exhaust resistance applied to gas sent from internal space 11*d* into internal space 21*d* increases and consequently blowing capability of fan assembly 1 lowers.

Figure 8:
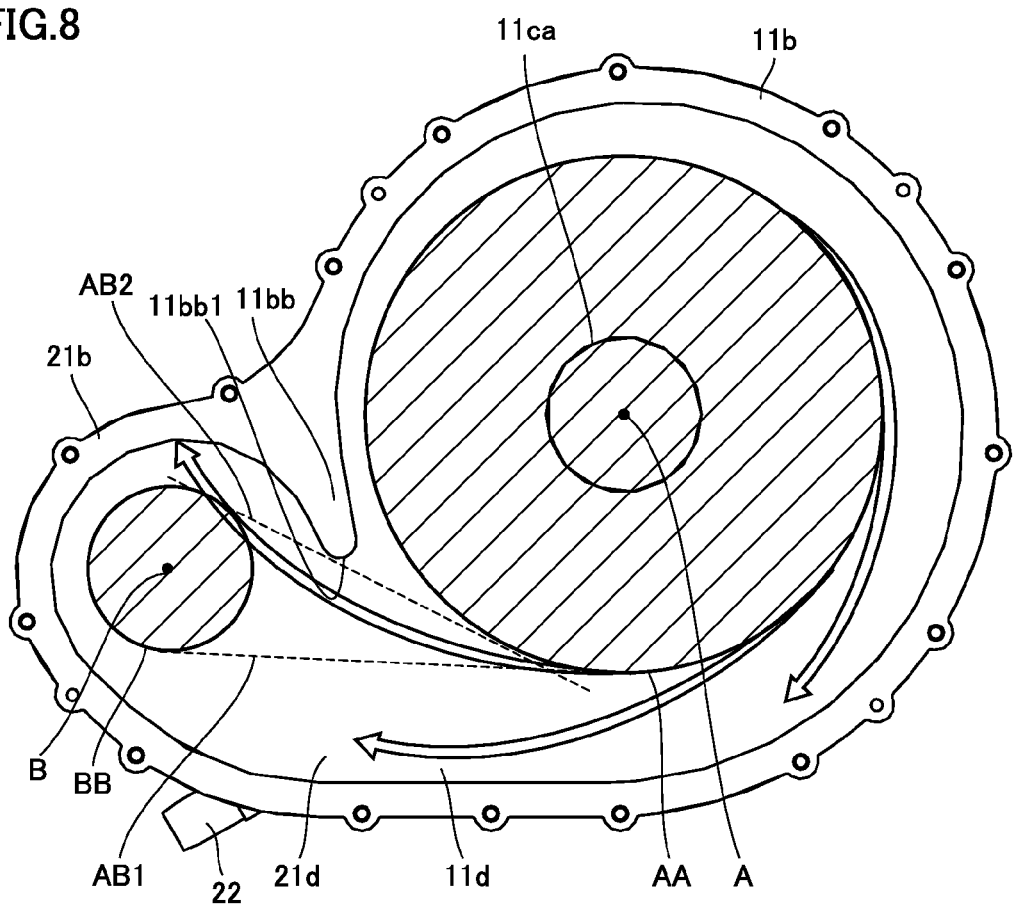
FIG. 8 is a schematic diagram for illustrating a direction of flow of gas sent from an outer circumferential portion of an impeller.

In contrast, referring to FIG. 8, tip end portion 11*bb*1 of tongue portion 11*bb* is provided to extend not to go beyond tangent AB1, so that the excessive narrow pathway of gas sent from the outer circumferential portion of impeller 12 in a logarithmic spiral manner can be suppressed. Thus, exhaust resistance applied to gas sent from internal space 11*d* into internal space 21*d* can be suppressed. Therefore, fan assembly 1 can be reduced in size without lowering in blowing capability of fan 10 and hence water heater 100 incorporating the same can be reduced in size.

FIG. 8 schematically shows a direction of flow of gas sent from each position in the outer circumferential portion of impeller 12. When flows of gas are generally shown collectively, gas sent from the side of fan case 11 toward connection portion case 21 is in a direction shown with hollow arrows in FIG. 7.

In fan assembly 1, tip end portion 11*bb*1 of tongue portion 11*bb* is further preferably located either on tangent AB2 of virtual tangents AB1 to AB4 in contact with the outer circumferential portion of region BB and the outer circumferential portion of region AA, or on the side of one end C1 relative to tangent AB2, for a reason below.

Referring to FIG. 8, tangent AB2 is approximate to a direction of flow of gas sent to be in contact with the outer circumferential portion of region BB, of gas sent from impeller 12 in a logarithmic spiral manner. Namely, when tongue portion 11*bb* goes beyond tangent AB2, such a flow of gas is interfered, which hence leads to increase in exhaust resistance of gas sent from internal space 11*d* into internal space 21*d*.

In other words, when tongue portion 11*bb* does not go beyond tangent AB2, increase in exhaust resistance as above can be suppressed. Therefore, tip end portion 11*bb*1 of tongue portion 11*bb* is provided to extend to be located either on tangent AB2 or on the side of one end C1 relative to tangent AB2, so that fan assembly 1 can be reduced in size without lowering in blowing capability of fan 10 and hence water heater 100 incorporating the same can be reduced in size.

In fan assembly 1, as described above, in linear region SL, distance d between tongue portion 11*bb* and region AA (the outer circumferential portion of impeller 12) preferably decreases from the side of the other end C2 toward one end C1.

In general, in order to ensure blowing performance of the fan, in the plan view from the direction of axis of rotation shaft 14, distance d between tongue portion 11*bb* and impeller 12 is designed to increase from the side of the other end C2 toward one end C1. In this case, however, fluctuation in pressure applied to gas around tip end portion 11*bb*1 is great, and hence NZ noise tends to be high.

In contrast, in linear region SL, distance d between tongue portion 11*bb* and region AA (the outer circumferential portion of impeller 12) decreases from the side of the other end C2 toward one end C1, so that pressure fluctuation generated between tongue portion 11*bb* and impeller 12 can be mitigated and hence NZ noise generated from the fan assembly can be lowered. Since distance d increases from the side of the other end C2 toward one end C1 in curved region CL continuing to linear region SL, blowing capability of fan 10 can sufficiently be maintained.

In the fan assembly, fan case 11 and connection portion case 21 are preferably integrally formed. Thus, a structure of fan assembly 1 is simplified and sending of gas from fan 10 to emission connection portion 20 is smooth. In the present embodiment, since top wall 11*a* of fan case 11 is different in material from circumferential wall 11*b* and bottom wall 11*c* and top wall 21*a* of connection portion case 21 is different in material from circumferential wall 21*b* and bottom wall 21*c*, the top wall is structured individually and differently from other walls. Top walls 11*a* and 21*a*, circumferential walls 11*b* and 21*b*, and bottom walls 11*c* and 21*c*, however, may integrally be formed.

In the present embodiment, water heater 100 adapted to the exhaust suction and combustion system is employed as above. Therefore, when connection pipe 108 is decreased in diameter, a combustion operation by burner 102 can be stabilized as compared with a water heater of what is called a forced exhaust type, which will be described below.

In a water heater of what is called a forced exhaust type, a fan, a burner, a primary heat exchanger, and a secondary heat exchanger are arranged in this order from upstream to downstream in a flow of combustion gas. Namely, combustion gas produced in the burner is caused to flow into an exhaust tube outside the water heater by the fan through the primary heat exchanger and the secondary heat exchanger.

Combustion gas forced out of the fan receives flow path resistance produced by the primary heat exchanger and the secondary heat exchanger before it reaches the exhaust tube. Therefore, a pressure with which combustion gas is sent immediately before the exhaust tube is lower by magnitude comparable to this flow path resistance. Therefore, in order to force combustion gas into the exhaust tube smaller in diameter, a fan blow pressure should be raised. When a fan blow pressure is raised, however, an internal pressure within a burner case becomes higher. Therefore, when a supply pressure of combustion gas supplied to the burner is low, a combustion operation becomes unstable.

In contrast, according to the exhaust suction and combustion system in the present embodiment, burner 102, primary heat exchanger 103, secondary heat exchanger 104, fan 10 of fan assembly 1, and emission connection portion 20 of fan assembly 1 are arranged in this order from upstream to downstream in the flow of combustion gas. With this system, since a pressure is negative on the upstream side of fan 10, an internal pressure within the burner case can be maintained low even though exhaust tube 108 is decreased in diameter. Thus, a combustion operation can be stabilized even when a supply pressure of combustion gas supplied to burner 102 is low.

FIGS. 4 to 8 each show a state that top wall 11*a* of fan case 11 and top wall 21*a* of connection portion case 21 have been removed in order to clarify each structure for internal space 11*d* in fan 10 and internal space 21*d* in emission connection portion 20.

Second Embodiment (Structure of Water Heater and Fan Assembly)

A water heater 200 including fan assembly 1 in the present embodiment will be described mainly with reference to FIG. 9. Water heater 200 is a water heater of a latent heat recovery type adapted to a forced exhaust system.

Figure 9:
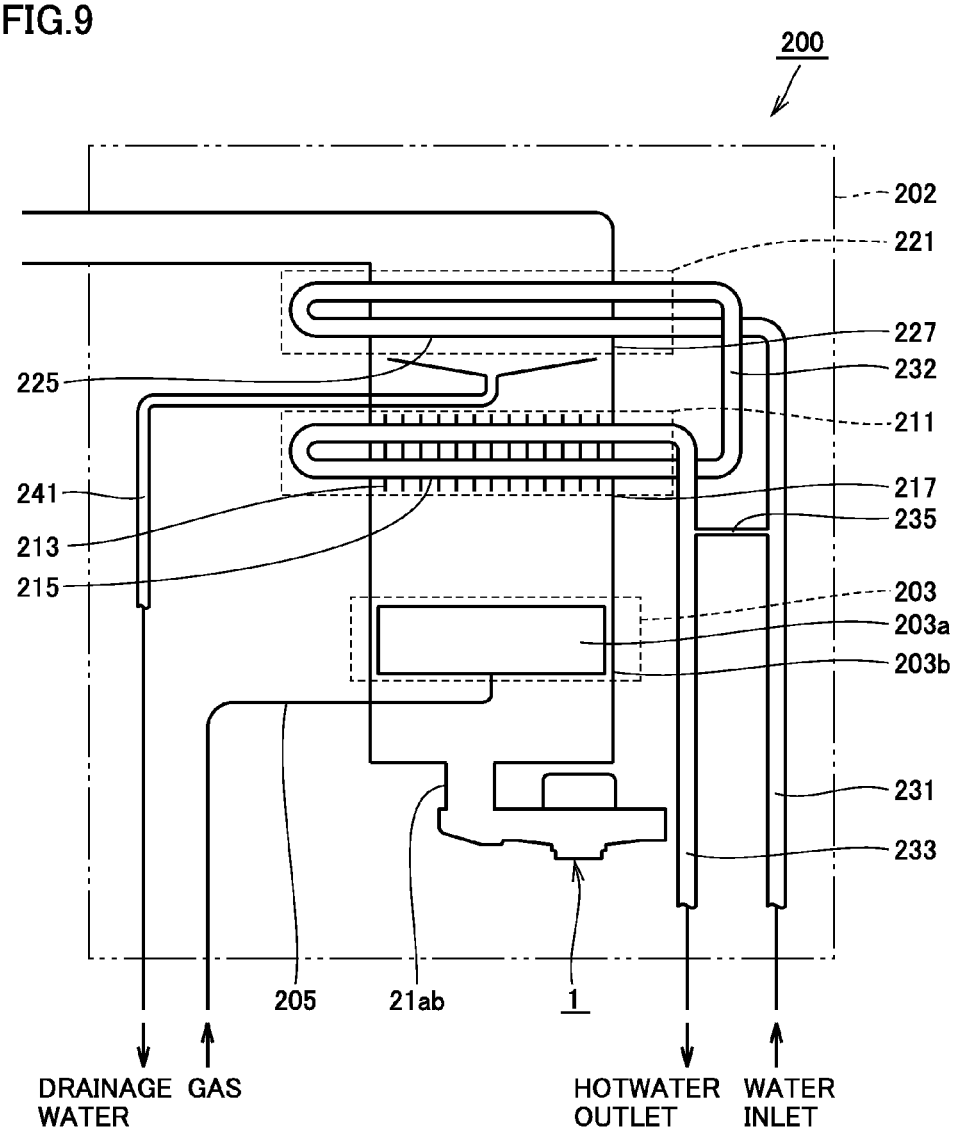
FIG. 9 is a schematic diagram for showing a structure of a water heater in one embodiment of the present invention.

Referring mainly to FIG. 9, water heater 200 mainly has a housing 202, a burner 203, fan assembly 1, a primary heat exchanger 211, and a secondary heat exchanger 221.

Burner 203 has a combustion portion 203*a* and a burner case 203*b*, and combustion portion 203*a* is accommodated in burner case 203*b*. A gas pipe 205 for supplying fuel gas to burner 203 is connected to this burner 203.

Fan assembly 1 serves to supply gas for combustion to burner 203. This fan assembly 1 is attached under burner 203. Namely, fan assembly 1 is located upstream of burner 203 in a flow of combustion gas. Since fan assembly 1 is the same as in the first embodiment in structure, description thereof will not be repeated. In the present embodiment, gas supplied to burner 203 by fan assembly 1 is mainly air and does not contain combustion gas. Water heater 200, however, is not limited thereto. For example, combustion gas and air may be mixed in fan assembly 1 and supplied to burner 203 (what is called a totally primary combustion system). In this case, piping for supplying combustion gas to fan assembly 1 is connected.

In the present embodiment, for example, connection portion 21*ab* provided to surround emission port 21*aa* of fan assembly 1 is attached to an opening provided in the bottom wall of burner case 203*b*, so that air for combustion emitted from fan assembly 1 can be sent to burner 203.

Referring mainly to FIG. 9, primary heat exchanger 211 is a heat exchanger of a sensible heat recovery type. This primary heat exchanger 211 has a plurality of stacked fins 213, a heat conduction pipe 215 penetrating the plurality of fins 213, and a shell plate 217 as a case accommodating the plurality of fins 213 and heat conduction pipe 215. Heat conduction pipe 215 has one end connected to a pipe 232 and the other end connected to a hot water delivery pipe 233. Primary heat exchanger 211 exchanges heat with combustion gas generated by burner 203, and specifically, it serves to heat water which flows through heat conduction pipe 215 of primary heat exchanger 211 with the quantity of heat generated as a result of the combustion operation of burner 203.

Referring mainly to FIG. 9, secondary heat exchanger 221 is a heat exchanger of a latent heat recovery type. This secondary heat exchanger 221 is located downstream of primary heat exchanger 211 in a flow of combustion gas and connected in series with primary heat exchanger 211. Since water heater 200 according to the present embodiment thus has secondary heat exchanger 221 of a latent heat recovery type, it is a water heater of the latent heat recovery type.

Primary heat exchanger 211 and secondary heat exchanger 221 are connected to each other through pipe 232. A water supply pipe 231 for supplying water to secondary heat exchanger 221 is connected to secondary heat exchanger 221. Hot water delivery pipe 233 for sending hot water from primary heat exchanger 211 is connected to primary heat exchanger 211.

Secondary heat exchanger 221 has a plurality of (herical) heat conduction pipes 225 and a case 227 accommodating heat conduction pipes 225. Heat conduction pipes 225 have one end connected to water supply pipe 231 and the other end connected to pipe 232.

Referring mainly to FIG. 9, a bypass pipe 235 is connected between water supply pipe 231 and hot water delivery pipe 233. This bypass pipe 235 serves to adjust a temperature of hot water sent from hot water delivery pipe 233 with water from water supply pipe 231. A drainage water discharge pipe 241 for discharging drainage water produced in secondary heat exchanger 221 is provided.

In water heater 200, as a prescribed amount of water is fed to water supply pipe 231, fan 10 of fan assembly 1 starts to rotate, burner 203 is ignited, and combustion gas is sent upward from burner 203. Sent combustion gas flows through a space surrounded by shell plate 217 where primary heat exchanger 211 is arranged, then flows through secondary heat exchanger 221, and thereafter is emitted out of water heater 200.

On the other hand, water sent through water supply pipe 231 initially flows through heat conduction pipes 225 in secondary heat exchanger 221. While water flows through secondary heat exchanger 221, water is pre-heated by combustion gas (latent heat). Then, pre-heated water is sent to primary heat exchanger 211 through pipe 232. Pre-heated water sent to primary heat exchanger 211 flows through heat conduction pipe 215 in a lower stage and then through heat conduction pipe 215 in an upper stage. While pre-heated water flows through heat conduction pipe 215, heat is exchanged between combustion gas (sensible heat) which flows through a gap between fins 213 and water in heat conduction pipe 215, and pre-heated water is heated to a prescribed temperature. Hot water heated to the prescribed temperature is sent out of water heater 200 through hot water delivery pipe 233.

(Function and Effect)

A function and effect of the fan assembly and the water heater in the present embodiment will be described.

Figure 10:
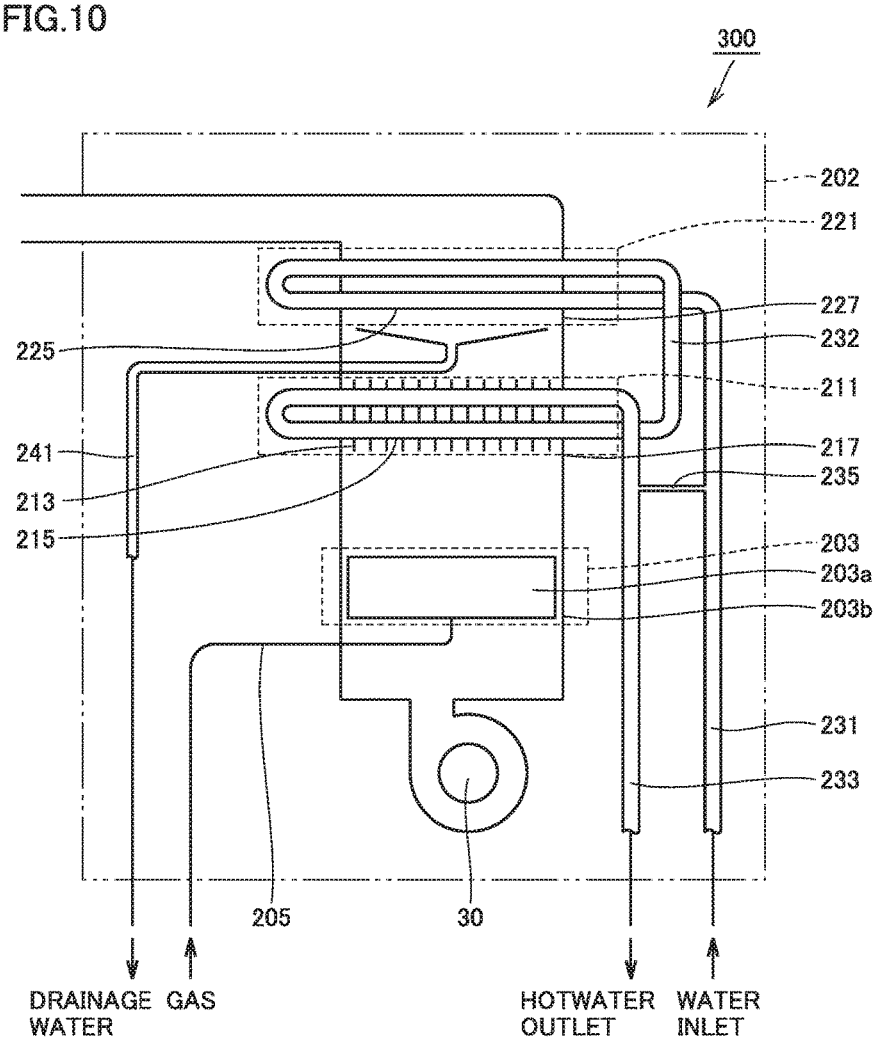
FIG. 10 is a schematic diagram showing a structure of a conventional water heater of a forced type.

When a conventional fan as disclosed in Japanese Patent Laying-Open No. 60-186617 is mounted on a water heater of a forced type, as shown in FIG. 10, a direction of the rotation shaft of the impeller is substantially perpendicular to the vertical direction in a state of placement of a water heater 300 and a direction of flow of gas sent from the impeller is substantially parallel to the vertical direction. In a fan 30, normally, an area in the direction of flow of gas sent from the impeller (a vertical direction in FIG. 10) tends to be greater than an area in the direction of the rotation shaft (a direction penetrating the sheet surface in FIG. 10). Therefore, when the conventional fan is mounted on the water heater of the forced type, a width (a height) in the vertical direction in the state of placement of the water heater is great and reduction in size cannot be achieved.

In contrast, according to fan assembly 1 in the present embodiment, fan 10 and emission port 21*aa* of emission connection portion 20 are provided at positions proximate to each other. Thus, as shown in FIG. 9, a surface greater in area in fan 10 can be arranged in a horizontal direction in the state of placement of water heater 200. Therefore, increase in width in the vertical direction of the water heater attributed to fan assembly 1 can be prevented and hence water heater 200 incorporating fan assembly 1 can be reduced in size.

In fan assembly 1, tongue portion 11*bb* is provided to extend to a position at least reaching straight line AB connecting center point B of region BB and center point A of region AA to each other. Thus, a backflow of gas can be suppressed by tongue portion 11*bb*, and hence water heater 200 incorporating fan 10 can be reduced in size without lowering in blowing capability of the fan.

Since a preferred structure and a function and effect of fan assembly 1 are otherwise the same as in the first embodiment, description thereof will not be repeated.

Third Embodiment (Structure of Water Heater and Fan Assembly)

A water heater 400 including a fan assembly 1A representing a modification of fan assembly 1 in the present embodiment will be described mainly with reference to FIG. 11. Water heater 400 is a water heater of a latent heat recovery type adapted to a forced exhaust system.

Figure 11:
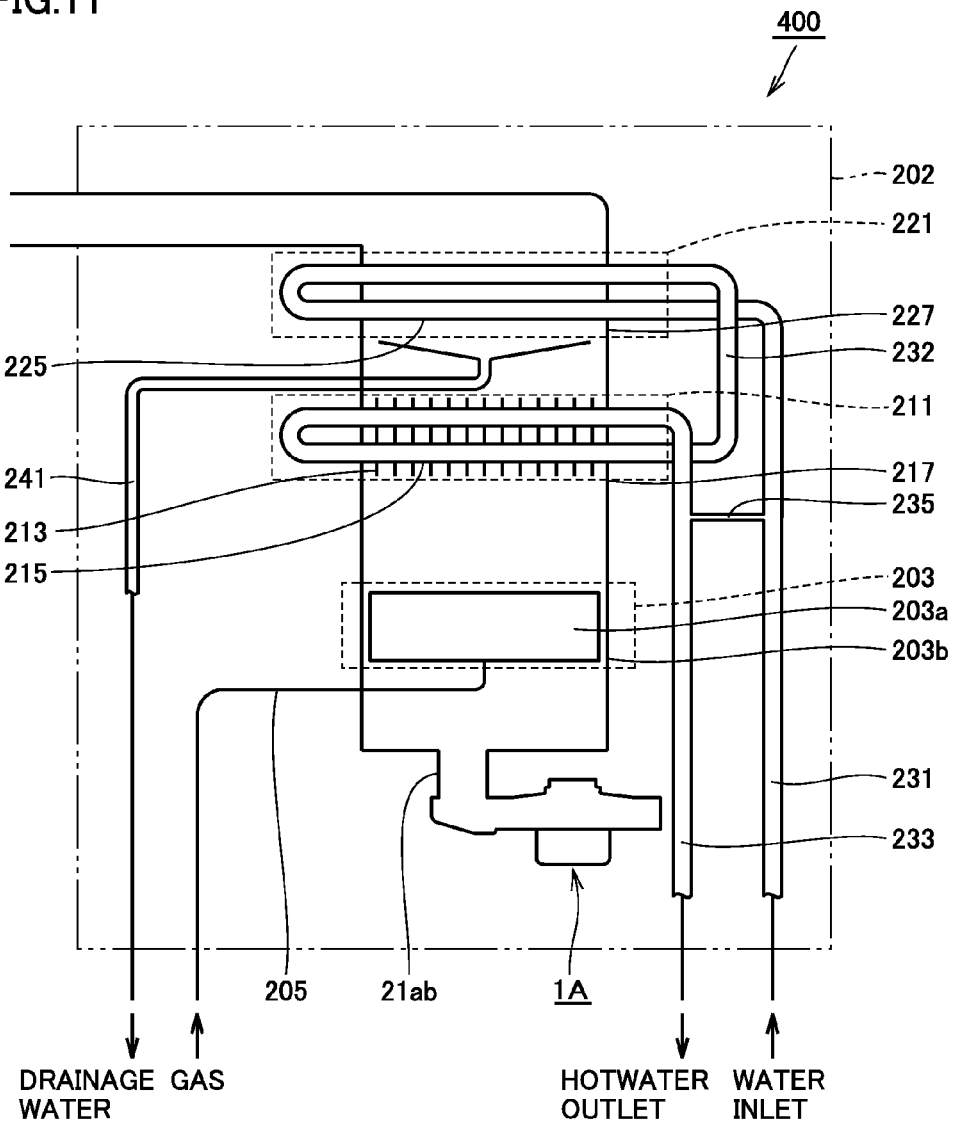
FIG. 11 is a schematic diagram showing a structure of a water heater in one embodiment of the present invention.

Referring mainly to FIG. 11, water heater 400 mainly has housing 202, burner 203, fan assembly 1A, primary heat exchanger 211, and secondary heat exchanger 221. Water heater 400 is different from water heater 300 in that fan assembly 1A is different in shape from fan assembly 1. Namely, since water heater 400 is the same as water heater 300 except for fan assembly 1A, description thereof will not be repeated.

Fan assembly 1A serves to supply gas for combustion to burner 203. This fan assembly 1A is attached under burner 203 as in water heater 300. Fan assembly 1A is different from fan assembly 1 in that a state of connection of fan 10 to emission connection portion 20 is opposite.

Specifically, top wall 21*a* provided with emission port 21*aa* and bottom wall 11*c* provided with suction port 11*cc* are connected to each other, and bottom wall 21*c* and top wall 11*a* through which rotation shaft 14 passes are connected to each other.

(Function and Effect)

A function and effect of the fan assembly and the water heater in the present embodiment is the same as in the second embodiment. Furthermore, according to the present embodiment, removal and attachment of fan assembly 1A during maintenance is further facilitated.

Although embodiments of the present invention have been described, it should be understood that the embodiments disclosed herein are illustrative and non-restrictive in every respect. The scope of the present invention is defined by the terms of the claims, and is intended to include any modifications within the scope and meaning equivalent to the terms of the claims.

What is claimed is:

1. A fan assembly for sending gas, comprising:

a fan including a fan case having a first internal space, an impeller accommodated in the first internal space, a drive source for driving the impeller, and a rotation shaft coupling the impeller and the drive source to each other; and an emission connection portion including a connection portion case having a second internal space and provided with an emission port for emitting gas sent from the fan to outside of the fan assembly through the second internal space, in a plan view from a direction of axis of the rotation shaft, a tongue portion being located at a boundary between the first internal space and the second internal space, and the tongue portion being provided to extend to a position at least reaching a virtual straight line connecting a center point of the emission port and a center of rotation of the rotation shaft to each other, from one end of the boundary toward the other end of the boundary, wherein in the plan view from the direction of axis of the rotation shaft, an opposing wall portion of the tongue portion opposed to an outer circumference of the impeller has a linear region extending linearly from a side of the other end of the boundary toward the one end of the boundary and a curved region located at a side of the one end of the boundary relative to the linear region and continuing to the linear region, in the linear region, a distance between the opposing wall portion of the tongue portion and the outer circumference of the impeller decreases from the side of the other end of the boundary toward the one end of the boundary, and the emission connection portion has a drainage water discharge portion communicating with the second internal space.

2. The fan assembly according to claim 1, wherein in the plan view from the direction of axis of the rotation shaft, a tip end portion of the tongue portion is located either on one of common external tangents of an outer circumference of the emission port and an outer circumference of the impeller, the one of the common external tangents including a position crossing the boundary, which is closest to the other end of the boundary among positions of virtual tangents of the emission port and the impeller crossing the boundary, or at a side of the one end of the boundary relative to the one of the common external tangents.

3. A water heater, comprising:

a combustion portion which generates combustion gas;

a heat exchanger which heats water which flows through inside, through heat exchange with combustion gas; and the fan assembly according to claim 2 which is located downstream of the heat exchanger in a flow of combustion gas and suctions combustion gas which has passed through the heat exchanger and emits combustion gas to outside of the water heater.

4. A water heater, comprising:

a combustion portion which generates combustion gas;

a heat exchanger which heats water which flows through inside, through heat exchange with combustion gas; and the fan assembly according to claim 2 which is located upstream of the combustion portion in a flow of combustion gas and sends gas to the combustion portion.

5. The fan assembly according to claim 1, wherein in the plan view from the direction of axis of the rotation shaft, the tongue portion is located either on one of common internal tangents of an outer circumference of the emission port and an outer circumference of the impeller, the one of the common internal tangents extending from the outer circumference of the impeller to the outer circumference of the emission port so as to come closer to the one end of the boundary from a side of the other end of the boundary, or at a side of the one end of the boundary relative to the one of the common internal tangents.

6. A water heater, comprising:

a combustion portion which generates combustion gas;

a heat exchanger which heats water which flows through inside, through heat exchange with combustion gas; and the fan assembly according to claim 5 which is located downstream of the heat exchanger in a flow of combustion gas and suctions combustion gas which has passed through the heat exchanger and emits combustion gas to outside of the water heater.

7. A water heater, comprising:

a combustion portion which generates combustion gas;

a heat exchanger which heats water which flows through inside, through heat exchange with combustion gas; and the fan assembly according to claim 5 which is located upstream of the combustion portion in a flow of combustion gas and sends gas to the combustion portion.

8. The fan assembly according to claim 1, wherein the fan case and the connection portion case are integrally formed.

9. A water heater, comprising:

a combustion portion which generates combustion gas;

a heat exchanger which heats water which flows through inside, through heat exchange with combustion gas; and the fan assembly according to claim 8 which is located downstream of the heat exchanger in a flow of combustion gas and suctions combustion gas which has passed through the heat exchanger and emits combustion gas to outside of the water heater.

10. A water heater, comprising:

a combustion portion which generates combustion gas;

a heat exchanger which heats water which flows through inside, through heat exchange with combustion gas; and the fan assembly according to claim 1 which is located downstream of the heat exchanger in a flow of combustion gas and suctions combustion gas which has passed through the heat exchanger and emits combustion gas to outside of the water heater.

11. A water heater, comprising:

a combustion portion which generates combustion gas;

a heat exchanger which heats water which flows through inside, through heat exchange with combustion gas; and the fan assembly according to claim 1 which is located upstream of the combustion portion in a flow of combustion gas and sends gas to the combustion portion.

* * * * *